US009526962B2

(12) United States Patent
Kegel

(10) Patent No.: US 9,526,962 B2
(45) Date of Patent: Dec. 27, 2016

(54) BALL TOSSING GAME FORMATION KIT

(71) Applicant: William Ryan Kegel, Elwood City, PA (US)

(72) Inventor: William Ryan Kegel, Elwood City, PA (US)

( * ) Notice: Subject to any disclaimer, the term of this patent is extended or adjusted under 35 U.S.C. 154(b) by 0 days.

(21) Appl. No.: 14/676,988

(22) Filed: Apr. 2, 2015

(65) Prior Publication Data

US 2016/0287961 A1 Oct. 6, 2016

(51) Int. Cl.

| | |
|---|---|
| ***A63B 67/02*** | (2006.01) |
| *A63H 33/32* | (2006.01) |
| *A63B 63/00* | (2006.01) |
| *A63B 67/06* | (2006.01) |

(52) U.S. Cl.

CPC ..... *A63B 67/02* (2013.01); *A63B 63/00* (2013.01); *A63B 67/06* (2013.01); *A63B 2067/061* (2013.01); *A63H 33/32* (2013.01)

(58) Field of Classification Search

CPC .... A63H 33/32; A63H 33/001; A63B 57/357; A63B 57/40; A63B 67/02; A63B 67/06; A63B 67/066

USPC 473/174, 175, 180, 181, 185; 273/398–402; 446/70

See application file for complete search history.

(56) References Cited

U.S. PATENT DOCUMENTS

| | | | | | |
|---|---|---|---|---|---|
| 2,451,711 | A * | 10/1948 | Beder | A63H 33/32 | 425/197 |
| 3,561,155 | A * | 2/1971 | Tarrson | A63H 33/32 | 446/160 |
| 3,736,697 | A * | 6/1973 | Keces | A63H 33/32 | 446/70 |
| 4,455,752 | A * | 6/1984 | Koulouras | A63H 33/32 | 33/41.4 |
| 5,125,459 | A * | 6/1992 | Richards | A63C 19/06 | 15/235.4 |
| 5,209,493 | A | 5/1993 | Chernek | | |
| 5,354,061 | A | 10/1994 | Gubany | | |
| 5,429,541 | A * | 7/1995 | Landon | A63H 33/32 | 383/4 |
| 5,460,561 | A * | 10/1995 | Dahlgren | A63H 33/04 | 446/103 |
| 5,487,545 | A | 1/1996 | Schindler | | |
| 5,575,483 | A | 11/1996 | Dineen et al. | | |
| 5,730,293 | A * | 3/1998 | Kelly | A63H 33/32 | 206/575 |
| 5,766,086 | A | 6/1998 | Folsom | | |
| D411,601 | S | 6/1999 | Fong | | |
| 6,367,797 | B1 | 4/2002 | McKenna-Cress et al. | | |
| 6,415,926 | B1 * | 7/2002 | Long | A63H 33/32 | 206/373 |

(Continued)

*Primary Examiner* — Mark Graham

(57) ABSTRACT

A ball tossing game formation kit includes a digging tool for forming a semi-spherical hole in a surface of sand. The digging tool comprises a plate having a first side. The perimeter edge includes a bottom edge, a top edge, a first side edge and a second side edge. The bottom edge is convexly arcuate from the first side edge to the second side edge. A depth line is defined extending between a juncture of the first side edge and the bottom edge and a juncture of the second side edge and the bottom edge. The bottom edge includes a distal edge with respect to the depth line. A distance from a center of the depth line to the distal edge is greater than 4.0 inches and less than 6.0 inches. A barrier mold is filled with sand and overturned to form the sand into a backstop.

6 Claims, 4 Drawing Sheets

(56) References Cited

U.S. PATENT DOCUMENTS

| | | | | |
|---|---|---|---|---|
| 7,371,144 | B1 * | 5/2008 | Begien | A63H 33/32<br>206/1.7 |
| 7,914,387 | B1 | 3/2011 | Gugliotti | |
| 2005/0277357 | A1 * | 12/2005 | Buckley | A63H 33/32<br>446/70 |
| 2008/0254706 | A1 * | 10/2008 | Taufield | A63F 9/02<br>446/70 |
| 2012/0156958 | A1 * | 6/2012 | Adams | A63H 33/32<br>446/70 |
| 2013/0017897 | A1 * | 1/2013 | Tsiopanas | A63B 67/02<br>473/174 |
| 2014/0106908 | A1 * | 4/2014 | Johnson | A63B 67/06<br>473/471 |

* cited by examiner

BALL TOSSING GAME FORMATION KIT

BACKGROUND OF THE DISCLOSURE

Field of the Disclosure

The disclosure relates to ball tossing game facilitating devices and more particularly pertains to a new ball tossing game facilitating device for helping a person to form a game area suitable for receiving tossed or rolled balls.

SUMMARY OF THE DISCLOSURE

An embodiment of the disclosure meets the needs presented above by generally comprising a digging tool configured for forming a semi-spherical hole in a surface of sand. The digging tool comprises a plate having a first side. The perimeter edge includes a bottom edge, a top edge, a first side edge and a second side edge. The bottom edge is convexly arcuate from the first side edge to the second side edge. A depth line is defined extending between a juncture of the first side edge and the bottom edge and a juncture of the second side edge and the bottom edge. The bottom edge includes a distal edge with respect to the depth line. A distance from a center of the depth line to the distal edge is greater than 4.0 inches and less than 6.0 inches. A barrier mold is provided that is configured to be filled with sand and overturned to form the sand into a backstop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
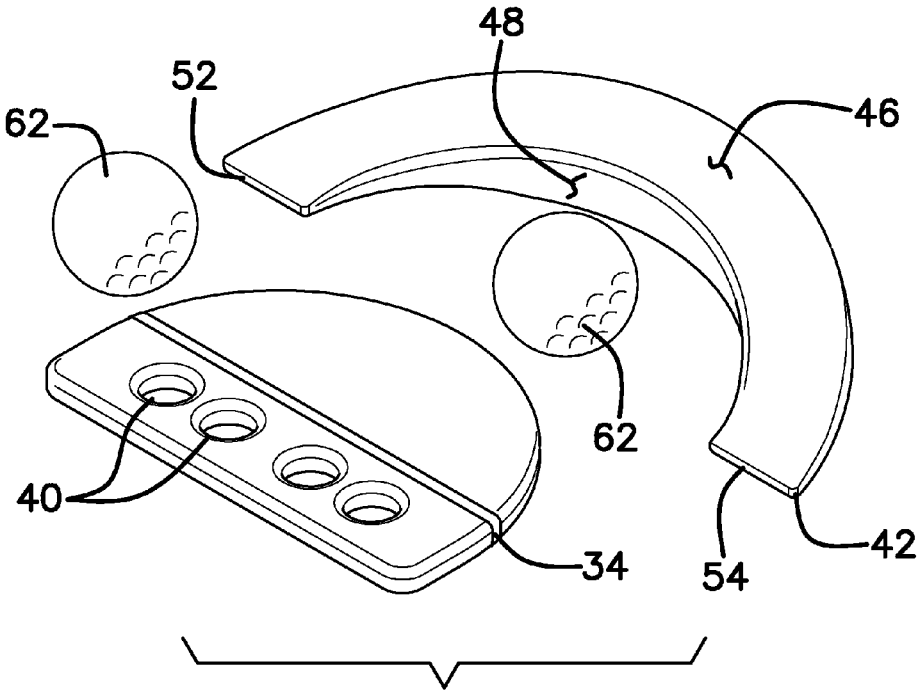
FIG. 1 is a front perspective view of a ball tossing game formation kit according to an embodiment of the disclosure.
Figure 2:
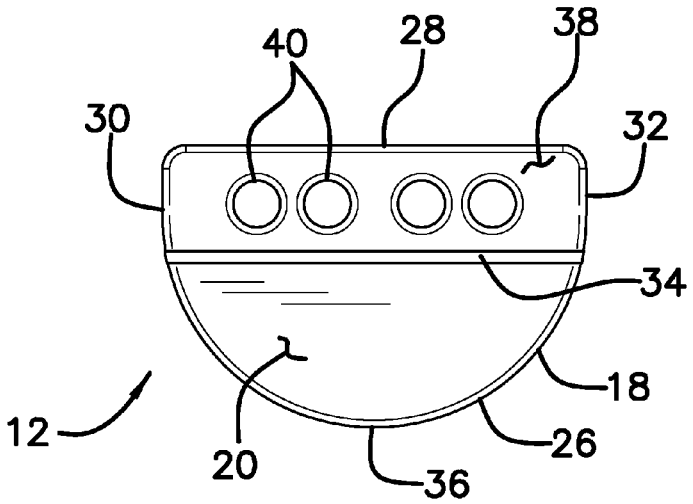
FIG. 2 is a front view of an embodiment of the disclosure.
Figure 3:
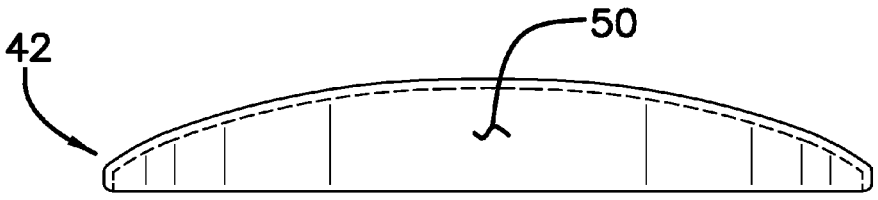
FIG. 3 is a rear view of an embodiment of the disclosure.
Figure 4:
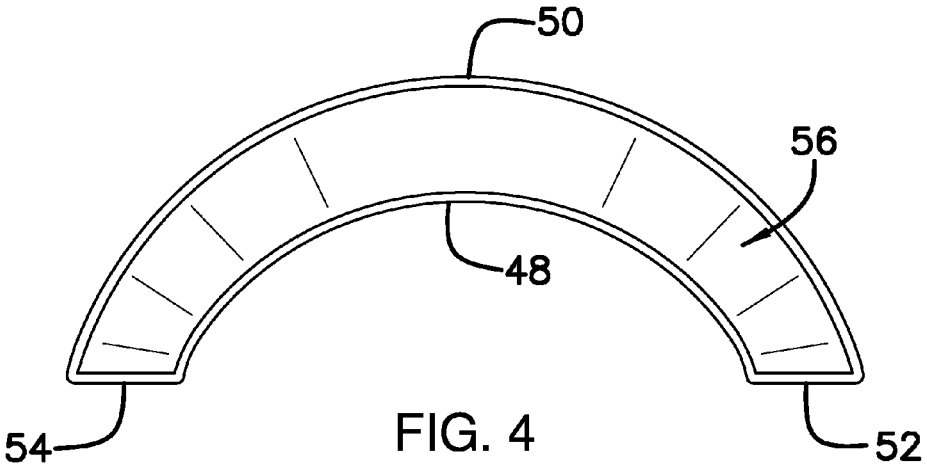
FIG. 4 is a bottom view of an embodiment of the disclosure.

With reference now to the drawings, and in particular to FIGS. 1 through 6 thereof, a new ball tossing game facilitating device embodying the principles and concepts of an embodiment of the disclosure and generally designated by the reference numeral 10 will be described.

As best illustrated in FIGS. 1 through 6, the ball tossing game formation kit 10 generally comprises a digging tool 12 configured for forming a semi-spherical hole 14 in a surface of sand 16. This may be done such as adjacent to a body of water and typically the sand 16 will be wet such that it generally retains its shape once manipulated as desired. The digging tool 12 comprises a plate 18 that has a first side 20, a second side 22 and a perimeter edge 24. The plate 18 is comprised of a rigid material which may include plastic materials. The plate 18 has a width from the first side 20 to the second side 22 which is less than 1.0 inches. The perimeter edge 24 includes a bottom edge 26, a top edge 28, a first side edge 30 and a second side edge 32 wherein the bottom edge 26 is convexly arcuate from the first side edge 30 to the second side edge 32. The bottom edge 26 is more particularly arced along a radius of a circle. A depth line 34 is defined extending between a juncture of the first side edge 30 and the bottom edge 26 and a juncture of the second side edge 32 and the bottom edge 26. The depth line 34 may or not be marked on the plate 18. The bottom edge 26 includes a distal edge 36 with respect to the depth line 34. A distance from a center of the depth line 34 to the distal edge 36 is greater than 4.0 inches and less than 6.0 inches and more particularly may be between 4.5 inches and 5.0 inches. A grip 38 is defined between the depth line 34 and the top edge 28. A plurality of finger holds 40 is positioned in the grip 38 and each of the finger holds 40 may comprise an aperture extending through the first 20 and second 22 sides.

Figure 5:
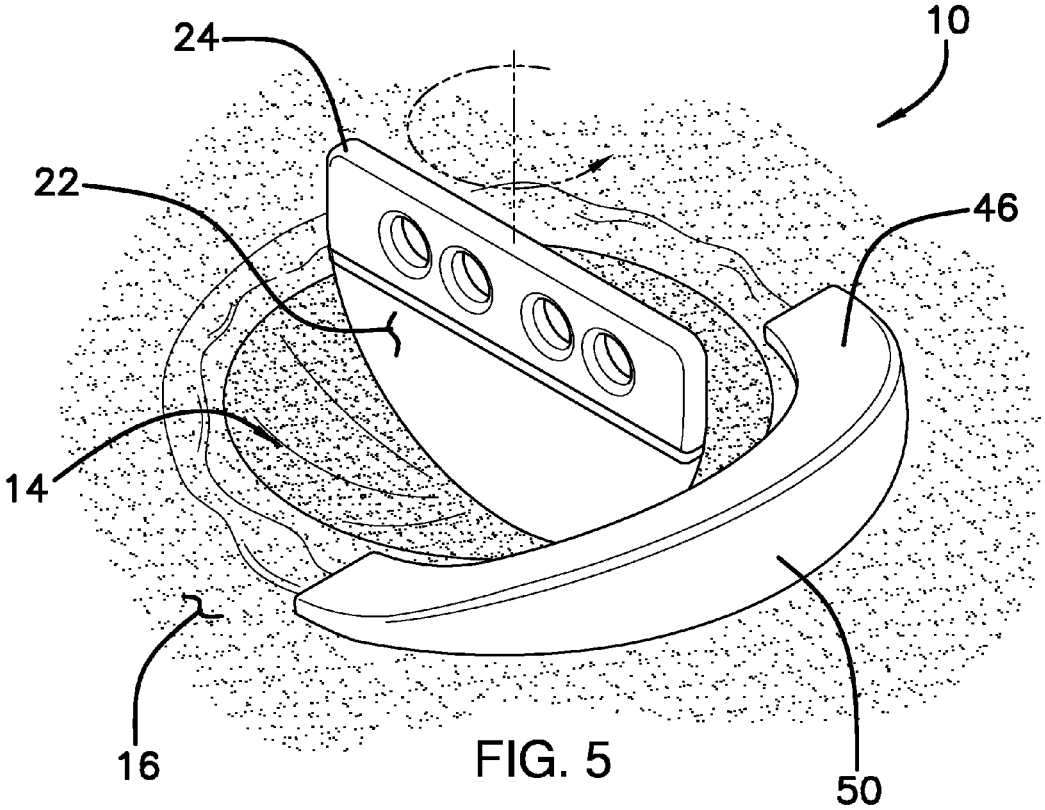
FIG. 5 is a rear perspective view of an embodiment of the disclosure.
Figure 6:
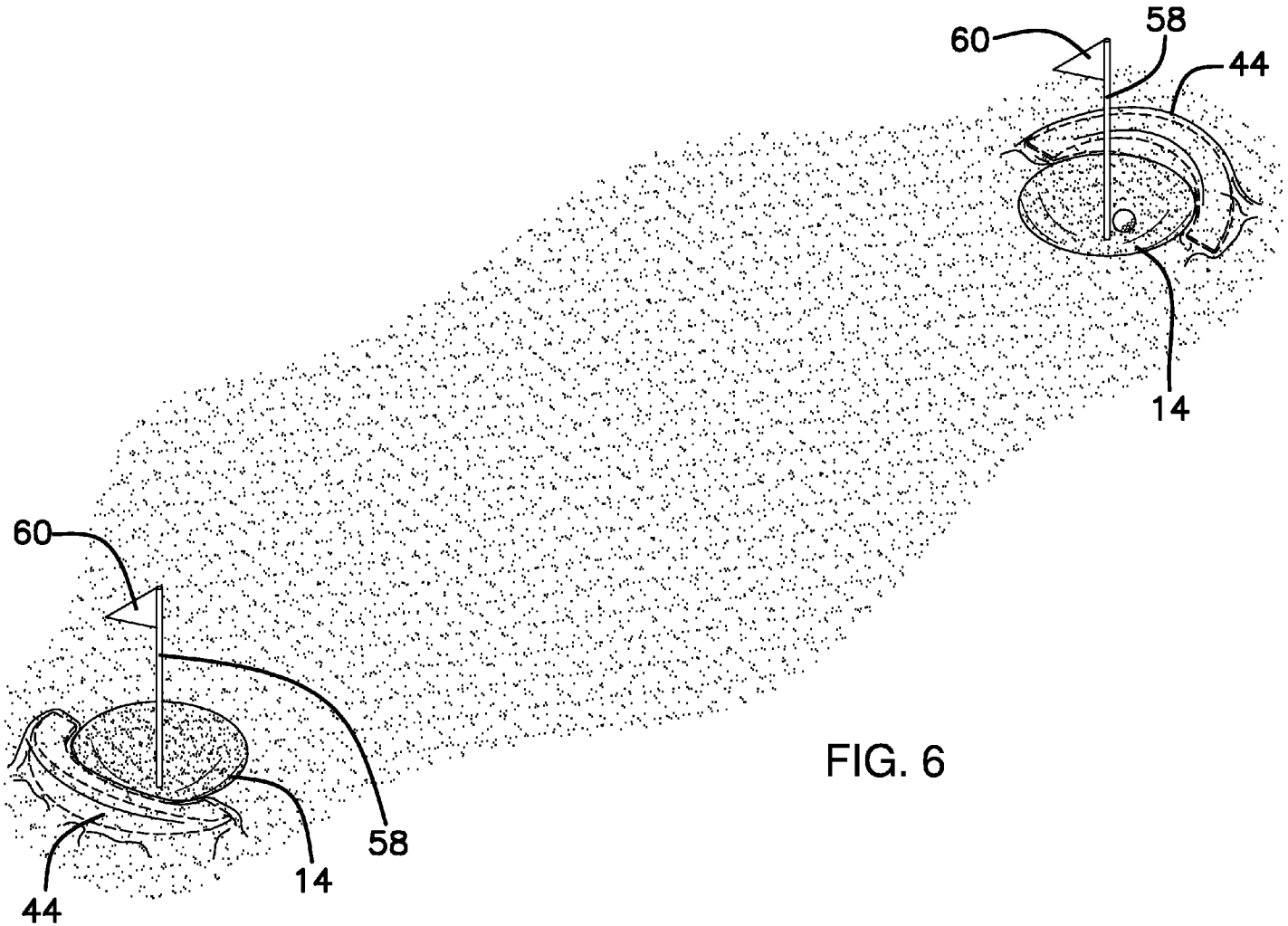
FIG. 6 is a perspective view of an embodiment of the disclosure.

A barrier mold 42 is provided that is configured to receive sand 16 to form a backstop 44 of a game to be played with the kit 10. The barrier mold 42 includes an upper wall 46, a front wall 48, a rear wall 50, a first end 52 and a second end 54 while a bottom 56 of the barrier mold 42 is open. The barrier mold 42 is substantially hollow so that the barrier mold 42 is configured to be filled with sand. Once the barrier mold 42 has been filled with sand 16, and the sand 16 compacted therein, the barrier mold 42 is overturned to form the sand 16 into the backstop. FIG. 6 shows the barrier mold 42 in phantom but the game would not be played with the barrier mold 42 and instead the sand formed into the backstop 44 would be utilized during game play. The front wall 48 is concavely arcuate and a height of the front wall 48 decreases from the central portion of the top wall to each of the first 52 and second 54 ends. As can be seen in FIG. 5, the first 52 and second 54 ends may each be facing a same direction. An arc of the front wall 48 substantially aligns with an arc of the bottom edge 26 of the digging tool 12 so that the backstop 44 may be aligned with the hole 14 in the sand 16.

A pair of posts 58 is provided and each has one of a pair of flags 60, which may be rigid or flexible, attached thereto. The posts 58 are configured to be extended into the sand 16 such that each of the posts 58 is vertically oriented. The posts 58 are typically placed in a center area of the hole 14 to help identify the hole 14 as a target.

A plurality of balls 62 is provided as well. The balls 62 may be any conventional ball but in particular the balls 62 may comprise standard golf balls as such as ubiquitous and have a substantially standard size.

In use, the plate 18 is used to form a pair of holes 14 in the sand 16. The holes 14 formed will have a semi to hemi-spherical shape. That is, the holes will form between ⅓ and ½ of a sphere. The holes 14 are shaped by inserting the bottom edge 36 into the sand 16 until the level of the sand is about equal to the depth line 34. The plate 18 is then rotated as shown in FIG. 5 to form the hold 14. The holes 14 are spaced a selected distance apart which may be between 15 feet and 25 feet. The backstops 44 are made with the barrier molds 42 as described above either before or after the holes 14 are made. The backstops 44 are abutted against the edges of the holes 14 and the backstops 44 face each other as is shown in FIG. 6. The posts 58 are then inserted into the sand 16, within the holes 14, to mark targets for ball 62 tossing. The game may then be placed by opposing players who attempt to toss or roll the balls 62 into the holes 14 to score points. The awarding of points and the determination of a winner may be achieved in any selected manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A game kit configured to form a playfield for a ball tossing game, said kit comprising:

a digging tool configured for forming a semi-spherical hole in a surface of sand, said digging tool comprising a plate having a first side, a second side and a perimeter edge, said perimeter edge including a bottom edge, a top edge, a first side edge and a second side edge, said bottom edge being convexly arcuate from said first side edge to said second side edge, a depth line being defined extending between a juncture of said first side edge and said bottom edge and a juncture of said second side edge and said bottom edge, said bottom edge including a distal edge with respect to said depth line, a distance from a center of said depth line to said distal edge being greater than 4.0 inches and less than 6.0 inches; and a barrier mold configured to be filled with sand and overturned to form the sand into a backstop, wherein said barrier mold includes an upper wall, a front wall, a rear wall, a first end and a second end, a bottom of said barrier mold being open, wherein said front wall is concavely arcuate, wherein a height of said front wall decreases from said central portion of said top wall to each of said first and second ends.

2. The game kit according to claim 1, wherein a grip is defined between said depth line and said top edge, a plurality of finger holds being positioned in said grip.

3. The game kit according to claim 2, wherein each of said finger holds comprises an aperture extending through said first and second sides.

4. The game kit according to claim 1, further including a pair of posts each having one of a pair of flags attached thereto, each of said posts being configured to be extended into the sand such that each of said posts is vertically oriented.

5. A game kit configured to form a playfield for a ball tossing game, said kit comprising:

a digging tool configured for forming a semi-spherical hole in a surface of sand, said digging tool comprising a plate having a first side, a second side and a perimeter edge, said perimeter edge including a bottom edge, a top edge, a first side edge and a second side edge, said bottom edge being convexly arcuate from said first side edge to said second side edge, a depth line being defined extending between a juncture of said first side edge and said bottom edge and a juncture of said second side edge and said bottom edge, said bottom edge including a distal edge with respect to said depth line, a distance from a center of said depth line to said distal edge being greater than 4.0 inches and less than 6.0 inches; and a barrier mold configured to be filled with sand and overturned to form the sand into a backstop, wherein said barrier mold includes an upper wall, a front wall, a rear wall, a first end and a second end, a bottom of said barrier mold being open, wherein said front wall is concavely arcuate, wherein an arc of said front wall substantially aligns with an arc of said bottom edge of said digging tool.

6. A game kit configured to form a playfield for a ball tossing game, said kit comprising:

a digging tool configured for forming a semi-spherical hole in a surface of sand, said digging tool comprising a plate having a first side, a second side and a perimeter edge, said plate having a width from said first side to said second side being less than 1.0 inches, said perimeter edge including a bottom edge, a top edge, a first side edge and a second side edge, said bottom edge being convexly arcuate from said first side edge to said second side edge, a depth line being defined extending between a juncture of said first side edge and said bottom edge and a juncture of said second side edge and said bottom edge, said bottom edge including a distal edge with respect to said depth line, a distance from a center of said depth line to said distal edge being greater than 4.0 inches and less than 6.0 inches, a grip being defined between said depth line and said top edge, a plurality of finger holds being positioned in said grip, each of said finger holds comprising an aperture extending through said first and second sides;

a barrier mold configured to receive sand form a backstop, said barrier mold including an upper wall, a front wall, a rear wall, a first end and a second end, a bottom of said barrier mold being open, said barrier mold being configured to be filled with sand and overturned to form the sand into the backstop, said front wall being concavely arcuate, a height of said front wall decreasing from said central portion of said top wall to each of said first and second ends, an arc of said front wall substantially aligning with an arc of said bottom edge of said digging tool; and a pair of posts each having one of a pair of flags attached thereto, each of said posts being configured to be extended into the sand such that each of said posts is vertically oriented.

* * * * *